US008045902B2

(12) United States Patent
Yabuki

(10) Patent No.: US 8,045,902 B2
(45) Date of Patent: Oct. 25, 2011

(54) DEVELOPER CONVEYING APPARATUS AND IMAGE FORMING APPARATUS

(75) Inventor: Makoto Yabuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 548 days.

(21) Appl. No.: 12/238,684

(22) Filed: Sep. 26, 2008

(65) Prior Publication Data

US 2009/0087223 A1 Apr. 2, 2009

(30) Foreign Application Priority Data

Sep. 27, 2007 (JP) ..... 2007-251357

(51) Int. Cl.
*G03G 15/095* (2006.01)

(52) U.S. Cl. ..... 399/264; 399/258; 399/259; 399/263

(58) Field of Classification Search ..... 399/256, 399/258, 259, 263, 35, 264, 358, 360
See application file for complete search history.

(56) References Cited

U.S. PATENT DOCUMENTS 5,177,536 A * 1/1993 Watanabe et al. ..... 399/222

FOREIGN PATENT DOCUMENTS

JP 08-314348 A 11/1996

* cited by examiner

*Primary Examiner* — David Gray
*Assistant Examiner* — Barnabas Fekete
(74) *Attorney, Agent, or Firm* — Panitch Schwarze Belisario & Nadel LLP

(57) ABSTRACT

A developer conveying apparatus includes a first developer storing portion, a second developer storing portion, and a conveying pipe that connects the first and second developer storing portions. The conveying pipe includes a tubular main body and a conveying member rotatably provided in the main body. A groove is formed on a surface of the conveying member, and the groove has a depth less than or equal to 5 μm.

8 Claims, 7 Drawing Sheets

DEVELOPER CONVEYING APPARATUS AND IMAGE FORMING APPARATUS

BACKGROUND OF THE INVENTION

The present invention relates to a developer conveying apparatus and an image forming apparatus.

A conventional image forming apparatus such as a printer, a copier, a facsimile machine, a complex machine is configured to form an image as follows. A surface of a photosensitive drum is uniformly charged by a charging roller. Then, the surface of the photosensitive drum is irradiated by an LED head so that a latent image is formed thereon. The latent image is developed by a developing roller in such a manner that a toner (i.e., a developer) forming a thin layer on the developing roller adheres to the latent image. The developed image (i.e., toner image) is transferred to a recording medium by a transfer roller. The residual toner remaining on the photosensitive drum after the transferring is scrapped off therefrom by a cleaning device, and is collected by the cleaning device.

The toner collected by the cleaning device is conveyed by a developer conveying apparatus to a developer storing container. The developer conveying apparatus has a conveying tube for conveying the toner. The conveying tube extends between the cleaning device and the developer storing container.

In some cases, detachable components of the image forming apparatus are disposed in the vicinity of the conveying tube. Therefore, the conveying tube is disposed so as to be curved, in order not to interfere with attachment/detachment of the detachable components (see, for example, Japanese Laid-open Patent Publication No. 8-314348).

A conveying spiral is provided inside the conveying tube. The conveying spiral is in the form of a coil, and is rotated to convey the developer through the conveying tube. The conveying spiral is curved along the curvature of the conveying tube.

SUMMARY OF THE INVENTION

The present invention is intended to provide a developer conveying apparatus and an image forming apparatus capable of reliably conveying a developer and capable of enhancing durability.

The present invention provides a developer conveying apparatus including a first developer storing portion, a second developer storing portion, and a conveying pipe that connects the first and second developer storing portions. The conveying pipe includes a tubular main body and a conveying member rotatably provided in the main body. A groove is formed on a surface of the conveying member, and the groove has a depth less than or equal to 5 μm.

Since the groove on the conveying member has the depth less than or equal to 5 μm, fatigue failure of the conveying member can be prevented. Therefore, the conveying member can reliably convey the developer, and a durability of the conveying member can be enhanced.

The present invention also provides a developer conveying apparatus including a first developer storing portion, a second developer storing portion, and a conveying pipe that connects the first and second developer storing portions. The conveying pipe includes a tubular main body and a conveying member rotatably provided in the main body. A notch effect factor of the conveying member obtained by nonlinear finite element analysis is in a range from 1.0 to 2.3.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, an embodiment of the present invention will be described with reference to the attached drawings. A color printer of tandem-type will be described as an example of an image forming apparatus.

First Embodiment

Figure 2:
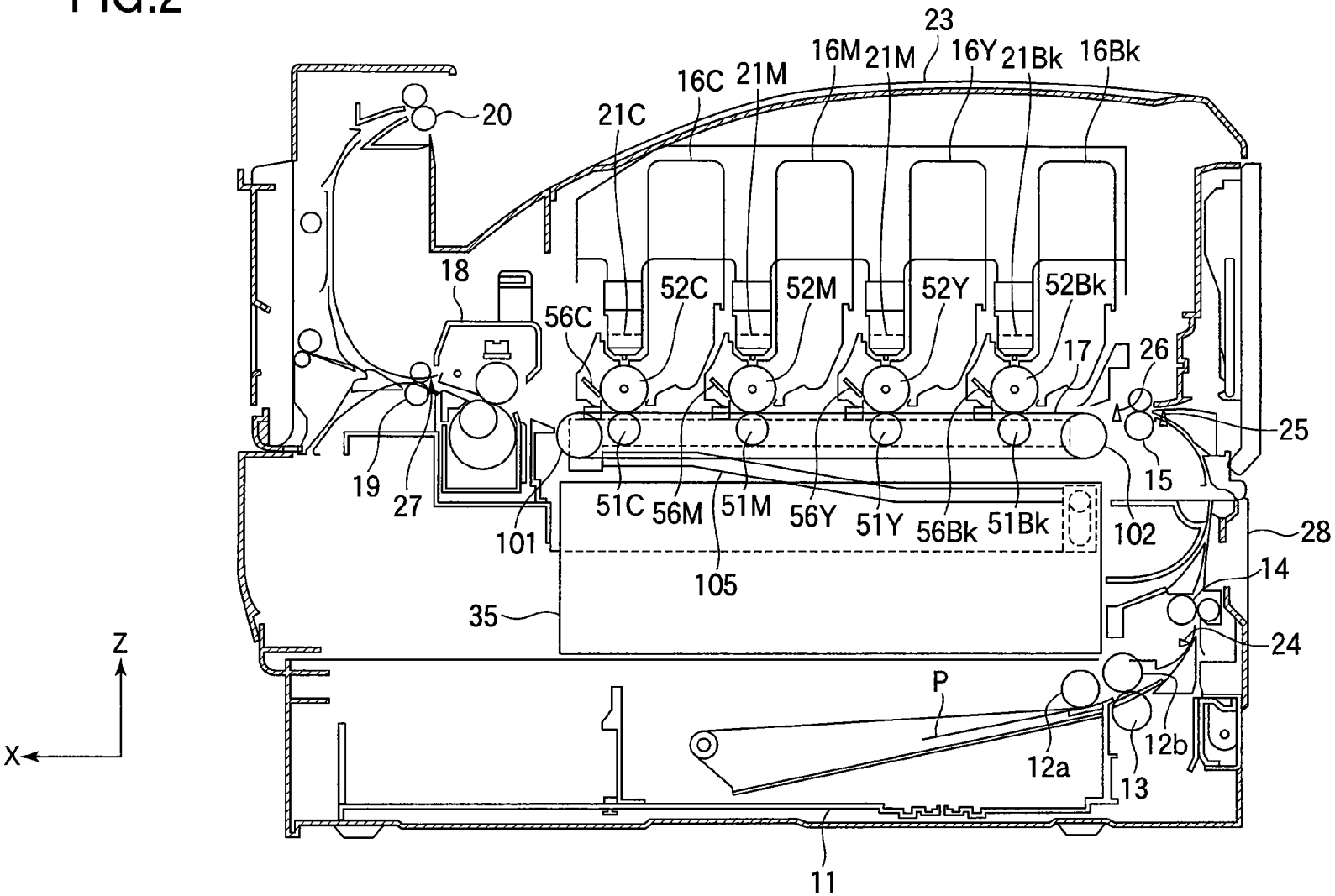
FIG. 2 is a schematic view showing a printer according to the first embodiment of the present invention.

FIG. 2 is a schematic view showing a printer (i.e., an image forming apparatus) according to the first embodiment of the present invention.

As shown in FIG. 2, a sheet cassette 11 (i.e., a medium storing portion) for storing sheets P (i.e., media) is disposed on the lower part of a main body 28 of the image forming apparatus. A sheet supplying mechanism is disposed adjacent to the sheet cassette 11. The sheet supplying mechanism includes a pickup roller 12*a*, a delivery roller 12*b* and a separation roller 13, which feed the sheet P individually out of the sheet cassette 11 into a sheet feeding path. A pair of feeding rollers 14 and another pair of feeding rollers 15 are disposed along the sheet feeding path. The feeding rollers 14 and 15 feed the sheet P to image forming units 16Bk, 16Y, 16M and 16C.

The image forming units 16Bk, 16Y, 16M and 16C (i.e., image forming portions) are arranged in a horizontal direction in FIG. 2 for forming toner images (developer images) of black, yellow, magenta and cyan. A transfer belt 17 (i.e., a first transfer member or a feeding member) is disposed facing the image forming units 16Bk, 16Y, 16M and 16C. The transfer belt 17 is stretched around a driving roller 101 and an idle roller 102 (i.e., a driven roller). Transfer rollers 51Bk, 51Y, 51M and 51C (i.e., second transfer members) are disposed between the driving roller 101 and the idle roller 102 so as to face the image forming units 16Bk, 16Y, 16M and 16C. The driving roller 101, the idle roller 102, the transfer rollers 51Bk, 51Y, 51M and 51C and the like constitute a transfer unit.

The image forming units 16Bk, 16Y, 16M and 16C includes photosensitive drums 52C, 52Y, 52M and 52C as image bearing bodies. LED heads 21Bk, 21Y, 21M and 21C (i.e., exposure devices) are disposed facing the photosensitive drums 52Bk, 52Y, 52M and 52C. LED heads 21Bk, 21Y, 21M and 21C irradiate the surfaces of the photosensitive drum 52Bk, 52Y, 52M and 52C to form latent images thereon.

Since the image forming units 16Bk, 16Y, 16M and 16C have the same configuration except the toners, the configuration of the image forming unit 16Bk will be herein described.

Figure 3:
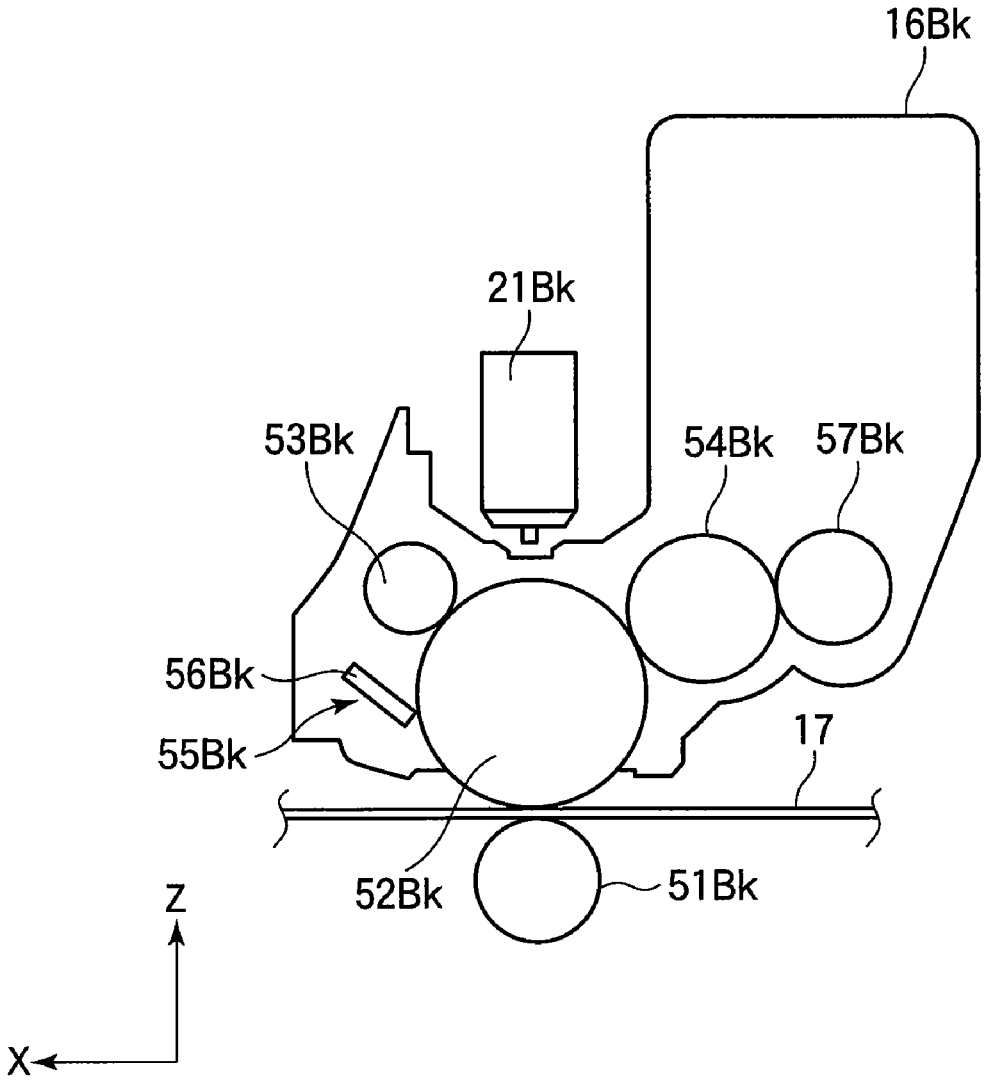
FIG. 3 is a schematic view showing an image forming unit of the printer according to the first embodiment of the present invention.

FIG. 3 shows the image forming unit 16Bk. The image forming unit 16Bk includes the photosensitive drums 52Bk, a charging roller 53Bk (i.e., a charging device), a developing roller 54Bk (i.e., a developer bearing body), a supplying roller 57Bk and a cleaning device 55Bk including a cleaning blade 56Bk. The charging roller 53Bk uniformly charges the surface of the photosensitive drum 52Bk. The LED head 21Bk irradiates the surface of the photosensitive drum 52Bk, so that a latent image is formed on the surface of the photosensitive drum 52Bk. The supplying roller 57Bk supplies the toner to the developing roller 54Bk. The developing roller 54Bk develops the latent image on the surface of the photosensitive drum 52Bk using the toner to thereby form a toner image. The transfer roller 51Bk transfers the toner image to the sheet P.

Referring back to FIG. 2, the transfer rollers 51Bk, 51Y, 51M and 51C respectively transfer the toner images of respective colors to the sheet P in an overlapping manner, with the result that a color image is formed.

The sheet P is subsequently fed to a fixing unit 18 (i.e., a fixing device) where the color image is fixed to the sheet P. The sheet P fed out of the fixing unit 18 is further fed by a pair of feeding rollers 19, and is ejected by a pair of ejection rollers 20 to the outside of the main body 28 of the printer.

The image forming units 16Bk, 16Y, 16M and 16C are detachably mounted to the main body 28 of the printer. An upper cover 23 is swingably provided on the upper part of the main body 28 of the printer. The LED heads 21Bk, 21Y, 21M and 21C are held by the upper cover 23.

Four sensors 24, 25, 26 and 27 (i.e., medium detecting units) are disposed along the feeding path of the sheet P. The sensor 24 is disposed in the vicinity of the feeding rollers 14 to detect whether the leading end of the sheet P (fed out of the sheet cassette 11) reaches the feeding rollers 14. The sensor 25 is disposed in the vicinity of the feeding rollers 15 to detect whether the leading end of the sheet P reaches the feeding rollers 15. The sensor 26 is disposed on the upstream side of the feeding rollers 17 to detect whether the leading end of the sheet P reaches the feeding rollers 17. The sensor 27 is disposed on the downstream side of the feeding rollers 19 to detect whether the tail end of the sheet P passes the feeding rollers 19.

As shown in FIG. 3, the toner remaining on the photosensitive drum 52Bk after the transferring is scraped off therefrom by the cleaning blade 56Bk (i.e., a cleaning member) of the cleaning device 55Bk, and is collected as a waste toner. Although not shown in FIG. 3, the toners remaining on the photosensitive drums 52Y, 52M and 52C after the transferring are similarly scraped off therefrom by cleaning blades 56Y, 56M and 56C (FIG. 2) and are collected as waste toners. The waste toner is conveyed by a developer conveying apparatus 105 (FIG. 1) to a developer storing container 35 as described later.

Next, a configuration of the developer conveying apparatus 105 will be described.

Figure 1:
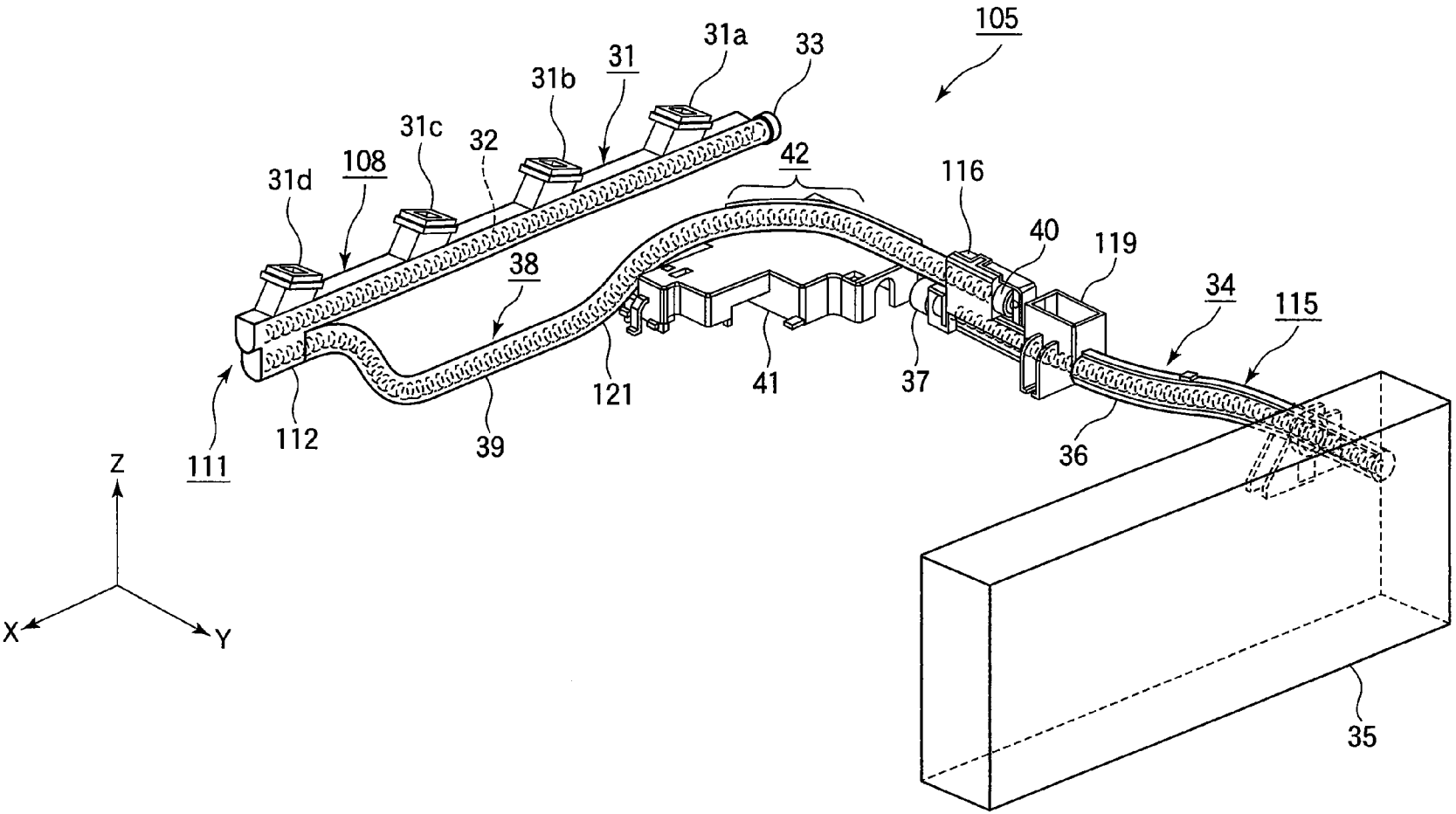
FIG. 1 is a perspective view showing a developer conveying apparatus according to the first embodiment of the present invention.

FIG. 1 is a perspective view showing the developer conveying apparatus 105 according to the first embodiment of the present invention.

In FIG. 1, the axial direction of the photosensitive drums 52Bk, 52Y, 52M and 52C (FIG. 2) is defined as Y-direction, and the vertical direction is defined as Z-direction. The direction perpendicular to both of the Y-direction and the Z-direction is defined as X-direction, along which the image forming units 16Bk, 16Y, 16M and 16C (FIG. 2) are arranged.

A developer storing container 35 is detachably mounted to the main body 28 (FIG. 2) of the printer. The developer conveying apparatus 105 is connected to the developer storing container 35, for conveying the waste toner to the developer storing container 35. The developer conveying apparatus 105 includes a waste toner conveying unit 31 (as a first developer conveying portion or a first developer storing portion) disposed below the image forming units 16Bk, 16Y, 16M and 16C and extending along the respective cleaning devices of the image forming units 16Bk, 16Y, 16M and 16C, and a waste toner conveying unit 34 (as a second developer conveying portion or a second developer storing portion) connected to the developer storing container 35. The developer conveying apparatus 105 further includes a conveying pipe 38 (as a third developer conveying portion) connecting the waste toner conveying units 31 and 34.

Figure 4:
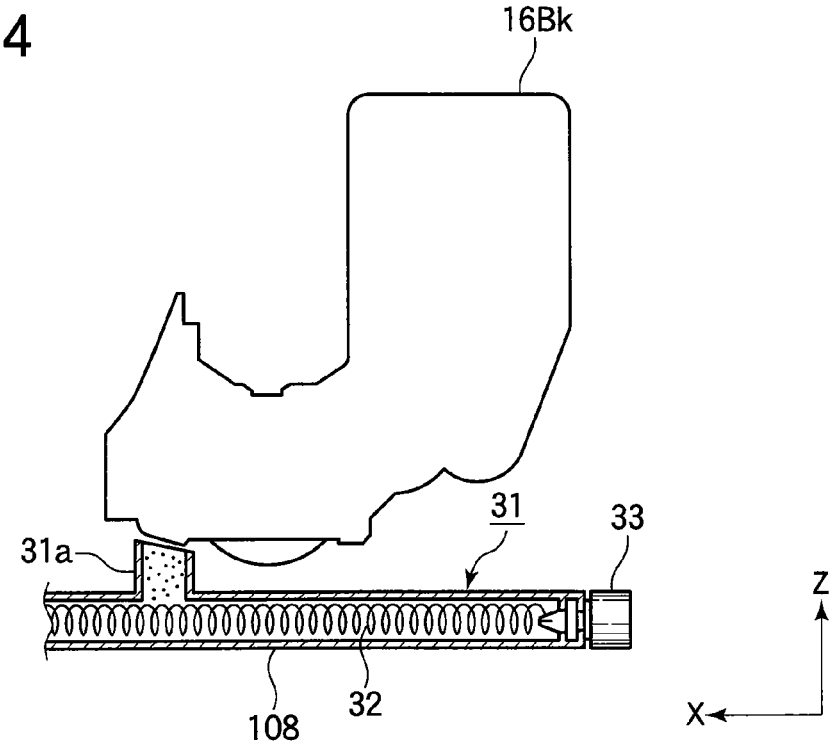
FIG. 4 is an enlarged view showing a part of the developer conveying apparatus according to the first embodiment of the present invention.

The waste toner conveying unit 31 includes a main body 108 composed of a substantially tubular body whose upper end is flat and whose lower end has a U-shaped cross section. As shown in FIG. 4, the waste toner conveying unit 31 further includes a conveying spiral 32 (as a conveying member) rotatably provided in the main body 108. The conveying spiral 32 extends from one end of the main body 108 (in this embodiment, the end closer to the image forming unit 16Bk) toward the other end of the main body 108 (in this embodiment, the end closer to the image forming unit 16C). The conveying spiral 32 is composed of a wire wound in the form of a coil.

Figure 5:
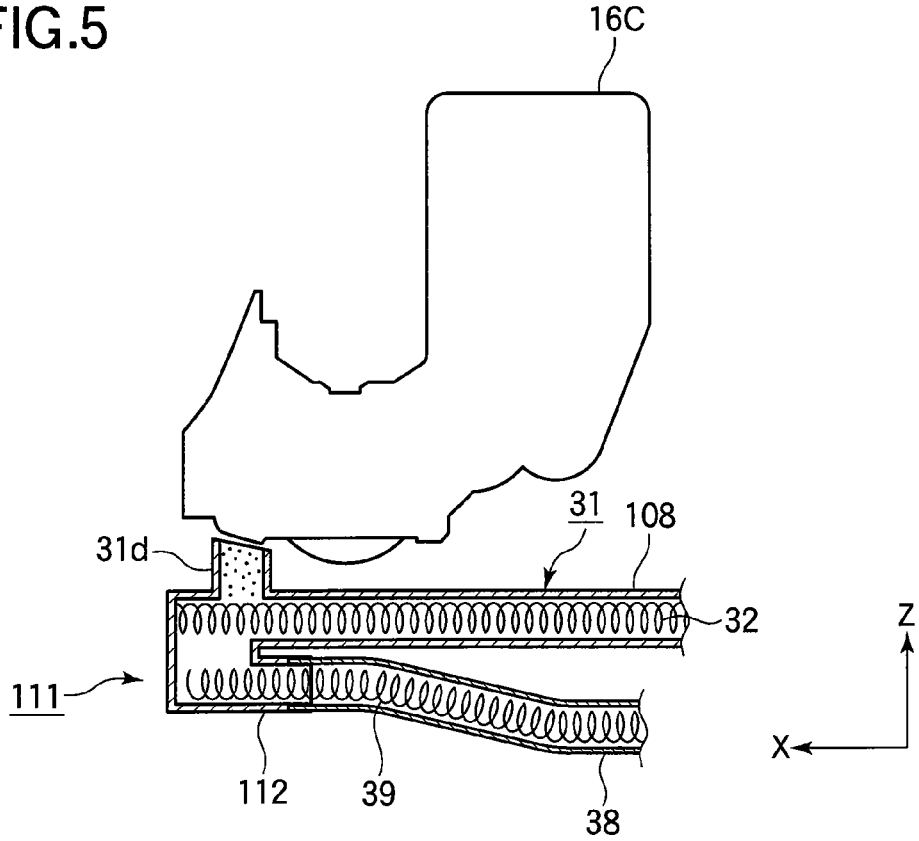
FIG. 5 is an enlarged view showing another part of the developer conveying apparatus according to the first embodiment of the present invention.

As shown in FIG. 5, the waste toner conveying unit 31 further includes an enlarged portion 112 which is enlarged downward from the end of the main body 108 (i.e., the end closer to the image forming unit 16C). The end of the main body 108 and the enlarged portion 112 constitute a turn-back portion 111. The enlarged portion 112 is connected to the conveying pipe 38.

As shown in FIG. 4, a gear 33 (i.e., a rotation transmitting element) is rotatably provided on the end of the main body 108 (i.e., the end closer to the image forming unit 16Bk). The gear 33 engages the conveying spiral 32. As shown in FIG. 1, receiving openings 31*a*, 31*b*, 31*c* and 31*d* are formed on the main body 108 for receiving waste toners from the image forming units 16Bk, 16Y, 16M and 16C.

Figure 6:
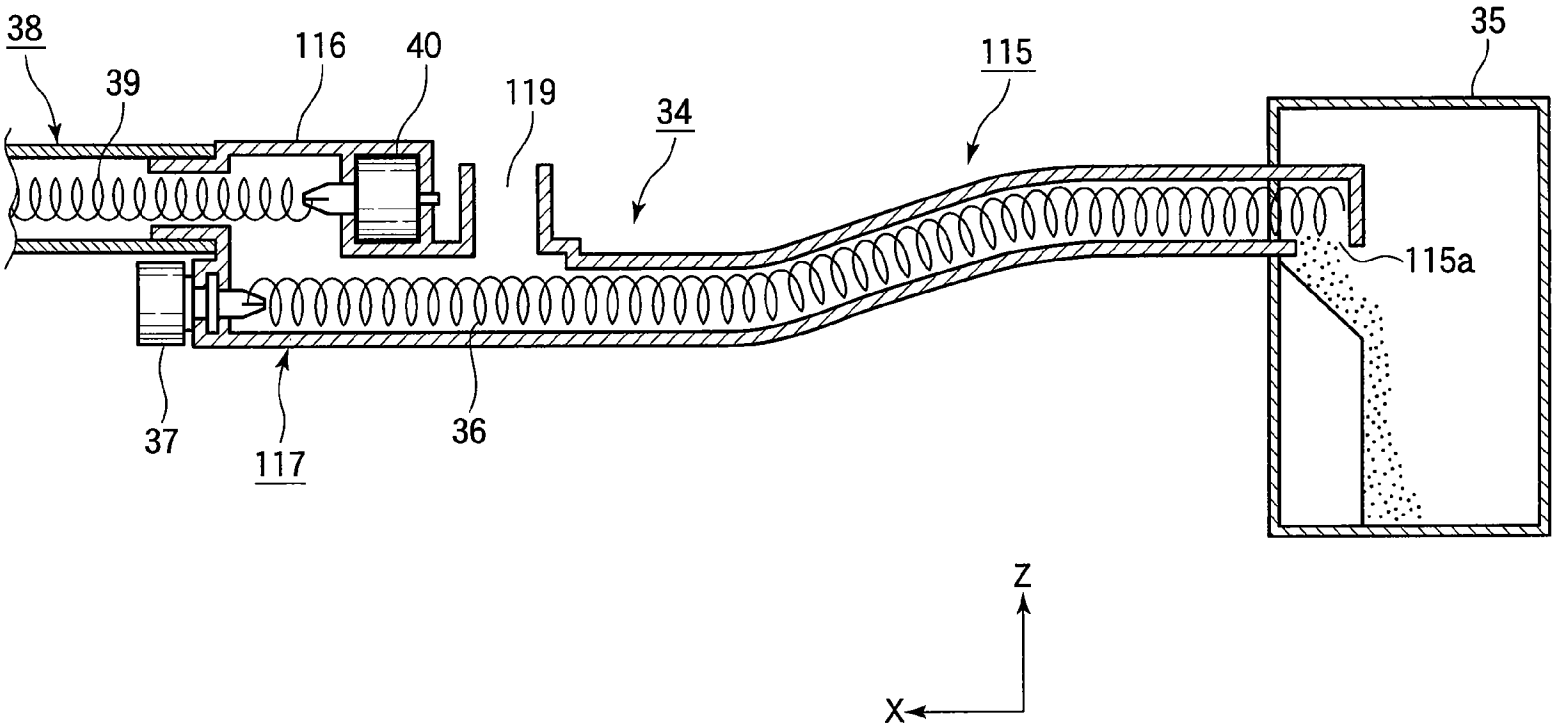
FIG. 6 is an enlarged view showing still another part the developer conveying apparatus according to the first embodiment of the present invention.

The waste toner conveying unit 34 includes a main body 115 composed of a substantially tubular body whose upper end is flat and whose lower end has a U-shaped cross section. As shown in FIG. 6, the waste toner conveying unit 34 further includes a conveying spiral 36 (i.e., a conveying member) rotatably provided in the main body 115. The conveying spiral 36 extends from one end of the main body 115 (in this embodiment, the end closer to the waste toner conveying unit 31) to the other end of the main body 108 (in this embodiment, the end closer to the developer storing container 35). The conveying spiral 36 is composed of a wire wound in the form of a coil. The waste toner conveying unit 34 further includes an enlarged portion 116 which is enlarged upward from the end of the main body 115 (i.e., the end closer to the conveying pipe 38). The end of the main body 115 and the enlarged portion 116 form a turn-back portion 117. The enlarged portion 116 is connected to the conveying pipe 38. An opening 119 facing upward is formed on the main body 115 adjacent to the enlarged portion 116. The opening 119 is provided for receiving a waste toner scraped off from the surface of the transfer belt 17 (FIG. 2) by a not shown cleaning device disposed below the transfer belt 17.

The other end of the main body 115 (i.e., the end closer the developer storing container 35) is inserted into the developer storing container 35, and has an opening 115*a* that faces downward. A gear 37 (i.e., a rotation transmitting element) is rotatably provided on the end of the main body 115 (i.e., the end closer to the conveying pipe 38). The gear 37 engages the conveying spiral 36.

As shown in FIG. 1, the conveying pipe 38 includes a main body 121 formed of a resilient material such as rubber and connects the enlarged portions 112 and 116, so as to communicate interiors of the main bodies 108 and 115. The conveying pipe 38 further includes a conveying spiral 39 rotatably provided in the main body 121 and extending between the enlarging portions 112 and 116. The conveying pipe 38 further includes a gear 40 (i.e., a rotation transmitting element) disposed on the end of the main body 121 (i.e., the end closer to the enlarged portion 116). The gear 40 engages the conveying spiral 39.

The gears 33, 37 and 40 are connected to a not shown motor (as a driving portion for conveying the waste toner) via predetermined gears. The rotation of the motor is transmitted to the gears 33, 37 and 40, so as to rotate the conveying spirals 32, 36 and 39 to convey the waste toner through the main bodies 108, 121 and 115.

Next, an operation of the developer conveying apparatus 105 will be described.

In the image forming units 16Bk, 16Y, 16M and 16C, after the toner images of the respective colors are transferred to the sheet P, the residual toner on the surfaces of the photosensitive drums 52Bk, 52Y, 52M and 52C is scraped off by the cleaning blades 56Bk, 56Y, 56M and 56C (FIG. 1) and is ejected to the waste toner conveying unit 31 via the receiving openings 31*a*, 31*b*, 31*c* and 31*d*. The waste toner is first stored in the main body 108 of the waste toner conveying unit 31. The conveying spiral 32 is rotated in the main body 108, and the waste tone is conveyed through the main body 108 in the direction from the image forming unit 16Bk toward the image forming unit 16C. The waste toner falls downward at the enlarging portion 112. Further, the conveying spiral 39 is rotated in the conveying pipe 38, and the waste toner is conveyed through the main body 121 of the conveying pipe 38 in the direction from the waste toner conveying unit 31 toward the waste toner conveying unit 34. The waste toner falls downward at the enlarging portion 116. Furthermore, the conveying spiral 36 is rotated in the waste toner conveying unit 34, the waste toner is conveyed through the main body 115 of the waste toner storing unit 34 from the conveying pipe 38 toward the developer storing container 35. The waste toner is falls downward through the opening 115*a* (FIG. 6) into the developer storing container 35.

The waste toner conveying unit 31 is disposed below the image forming units 16Bk, 16Y, 16M and 16C, and extends substantially in the X-direction. The developer storing container 35 is disposed in the main body 28 (FIG. 2) of the printer on a position close to one end of the main body 28 in the Y-direction, and the waste toner conveying unit 34 extends in the Y-direction, i.e., substantially perpendicular to the waste toner conveying unit 31. Therefore, a curved portion 42 is formed on the pipe 38 between the enlarging portions 112 and 116. The curved portion 42 is guided by a guide member 41 (fixed to the main body 28) so that the curved portion 42 has a predetermined radius of curvature R.

Next, a configuration of the curved portion 42 of the conveying pipe 38 will be described.

Figure 7:
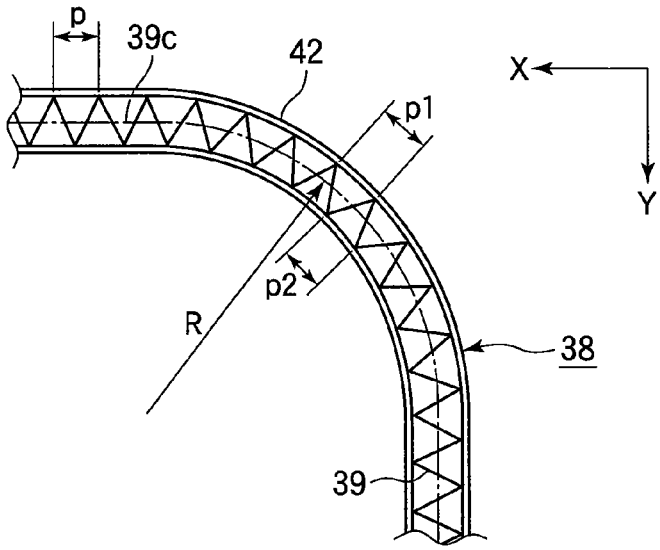
FIG. 7 is a sectional view showing a curved portion of a conveying pipe according to the first embodiment of the present invention.

FIG. 7 is a sectional view showing a curved portion 42 of the conveying pipe 38 according to the first embodiment of the present invention.

As shown in FIG. 7, the conveying spiral 39 is curved with the same radius of curvature R as the conveying pipe 38 at the curved portion 42. In other words, an imaginary center axis 39*c* of the conveying spiral 39 is curved with the radius of curvature R at the curved portion 42. Therefore, the conveying spiral 39 is extended (stretched) at the outer side of the curved portion 42, and is contracted at the inner side of the curved portion 42. Here, the winding pitch (i.e., a lead) of the conveying spiral 39 at a straight portion (where the center axis 39*c* straightly extends) is expressed as p. The winding pitch of the conveying spiral 39 at the outer side of the curved portion 42 is expressed as p1. The winding pitch of the conveying spiral 39 at the inner side of the curved portion 42 is expressed as p2. The pitches p, p1 and p2 satisfy the following relationship:

$$p2<p<p1.$$

Therefore, when the conveying spiral 39 rotates, the conveying spiral 39 is repeatedly subjected to extension and contraction.

Next, a manufacturing process of the conveying spiral 32, 36 and 39 will be described. Since the conveying spiral 32, 36 and 39 are manufactured in a similar manner, the manufacturing process of the conveying spiral 39 will be described.

Figure 8:
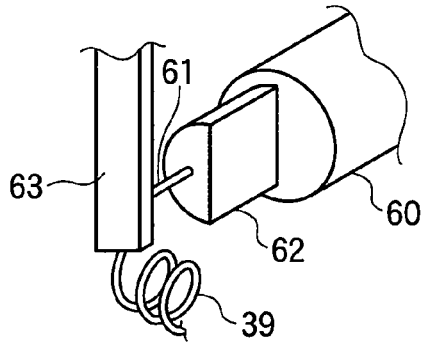
FIG. 8 is a perspective view for illustrating a manufacturing process of the conveying spiral according to the first embodiment of the present invention.
Figure 9:
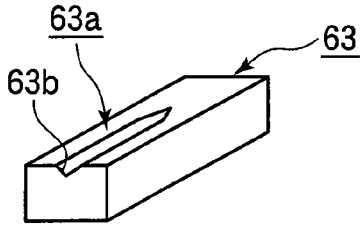
FIG. 9 is a perspective view for illustrating the manufacturing process of the conveying spiral according to the first embodiment of the present invention.
Figure 10:
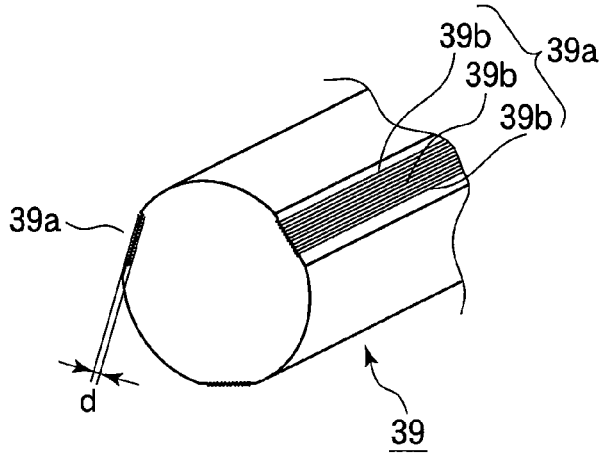
FIG. 10 is a perspective view showing an example of grooves formed on the conveying spiral according to the first embodiment of the present invention.
Figure 11:
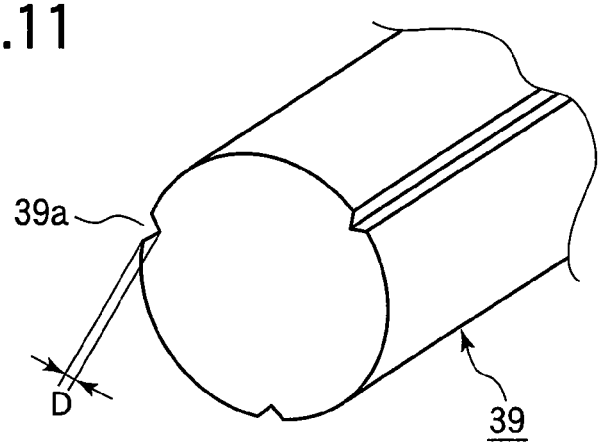
FIG. 11 is a perspective view showing another example of grooves formed on the conveying spiral according to the first embodiment of the present invention.

FIGS. 8 and 9 are perspective views for illustrating the manufacturing process of the conveying spiral. FIG. 10 is a perspective view for illustrating an example of grooves formed on the conveying spiral. FIG. 11 is a perspective view for illustrating another example of grooves formed on the conveying spiral.

A multi-forming machine 60 is generally used in the manufacturing process of the conveying spiral 39. A wire 61 (that forms the conveying spiral 39) is extruded from a cap 62 of the multi-forming machine 60, and is formed into a coil-shape by a tool 63, as shown in FIG. 8. To be more specific, the tool 63 has a groove 63*a* having a V-shaped cross section as shown in FIG. 9. The wire 61 extruded from the cap 62 proceeds (almost straightly) toward the tool 63 and contacts the groove 63*a* of the tool 63. The wire 61 is guided by the groove 63*a*, and changes proceeding direction so that the wire 61 is formed into a coil-shape. In this regard, when the wire 61 is guided by the tool 63, the wire 61 is rubbed against an edge portion 63*b* at the end of the groove 63*a*. With this rubbing, grooves 39*a* (FIG. 10 or 11) may be formed on the outer surface of the wire 61. In an example shown in FIG. 10, each groove 39*a* takes the form of a plurality of fine grooves 93*b* having depth (d) of less than or equal to 5 μm. In another example shown in FIG. 11, each groove 39*a* takes the form of a groove having a V-shaped cross section.

Therefore, when the conveying spiral 39 is repeatedly subjected to extraction and contraction at the curved portion 42 due to the rotation of the conveying spiral 39, fatigue of conveying spiral 39 may occur due to the effect of the grooves 39*a*. Therefore, the conveying spiral 39 may be damaged depending on material, wire-diameter, outer diameter, winding pitch or the like of the conveying spiral 39. As a result, there is a possibility that the conveying spiral 39 may become unable to convey the waste toner to the developer storing container 35, so that the durability of the developer conveying apparatus 105 may be degraded.

For this reason, a durability test is performed. In this durability test, the conveying spiral 39 is repeatedly rotated while changing the depth (i.e., the distance from the outer surface of the conveying spiral 39) of the groove 39, and whether fatigue failure occurs or not is evaluated.

In the durability test, the total number of rotations of the conveying spiral 39 is $10^7$ rotations. The radius of curvature R of the curved portion 42 is 70 mm. The material of the conveying spiral 39 is a stainless steel "SUS304P". The wire diameter of the conveying spiral 39 is 0.6 mm. The outer diameter (average) of the conveying spiral 39 is 7.4 mm. The winding pitch p of the conveying spiral 39 is 9 mm. The evaluation of fatigue failure and the measurement of the depth of the groove 39*a* are performed using a laser microscope. The evaluation result is shown in TABLE 1.

TABLE 1

| | DEPTH OF GROOVE(μm) | | | | | | | |
|---|---|---|---|---|---|---|---|---|
| | 0.3 | 0.5 | 1 | 2 | 3 | 4 | 5 | 6 |
| FATIGUE FAILURE | ○ | ○ | ○ | ○ | ○ | ○ | ○ | X |

In TABLE 1, "O" indicates that fatigue failure does not occur, and "X" indicates that fatigue failure occurs. The fatigue failure does not occur in the case where the depth of the groove 39*a* is less than or equal to 5 μm even when the conveying spiral 39 rotates for $10^7$ rotations. In contrast, the fatigue failure occurs in the case where the depth of the groove 39*a* is greater than 5 μm even when the conveying spiral 39 rotates less than $10^7$ rotations.

The durability test is also performed on the conveying spirals 39 having the radius of curvature R (of the curved portion 42) in a range from 30 mm to 70 mm. In this case, the same result as TABLE 1 is obtained. Further, the durability test is also performed on the conveying spirals 39 having the radius of curvature R less than 30 mm. In this case, fatigue failure occurs irrespective of the depth of the groove 39*a*, because a torsion stress on the conveying spiral 39 increases. The durability test is not performed on the conveying spiral 39 having the radius of curvature R greater than 70 mm, because, in such a case, the size of the printer becomes large.

The durability test is also performed on the conveying spirals 39 having the wire diameter (of the wire 61) in a range from 0.3 mm to 1.0 mm. In this case, the same result as TABLE 1 is obtained. Further, the durability test is also performed on the conveying spirals 39 having the wire diameter less than 0.3 mm. In this case, the clogging of toner occurs, because the conveying spiral 39 can not push the waste toner even when the conveying spiral 39 is rotated (i.e., a conveying performance of the waste toner is degraded). The durability test is also performed on the conveying spirals 39 having the wire diameter greater than 1.0 mm. In this case, fatigue failure occurs, because a torsion stress on the conveying spiral 39 increases.

Further, the durability test is also performed on the conveying spirals 39 having the outer diameter D in a range from 7 mm to 8 mm. In this case, the same result as TABLE 1 is obtained. The durability test is also performed on the conveying spirals 39 having the winding pitch p in a range from 7 mm to 11 mm. In this case, the same result as TABLE 1 is obtained.

As described above, according to the first embodiment of the present invention, since the depth of the groove 39*a* on the surface of the conveying spiral 39 is less than or equal to 5 μm, it becomes possible to prevent fatigue failure of the conveying spiral 39. Therefore, the waste toner can be reliably conveyed to the developer storing container 35, with the result that the durability of the developer conveying apparatus 105 can be enhanced.

An example of manufacturing process for forming the conveying spiral 39 having a groove whose depth is less than or equal to 5 μm will be described later with reference to FIGS. 12 and 13 (i.e., the third embodiment).

Second Embodiment

Next, the second embodiment of the present invention will be described. Components that are the same as those of the first embodiment are assigned the same reference numerals. Regarding advantages obtained by the components that are the same as those of the first embodiment, the explanations thereof in the first embodiment are herein incorporated.

In the second embodiment, a relationship between the radius of curvature R of the curved portion 42 and a torsion stress τ generated by the rotation of the conveying spiral 39 (i.e., the conveying member) is examined. The radius of curvature of the curved portion 42 is expressed as R (mm). The wire diameter of the wire 61 is expressed as d (mm). The outer diameter of the conveying spiral 39 is expressed as D (mm). The winding pitch of the conveying spiral 39 is expressed as p (mm). The transverse elasticity coefficient of the conveying spiral 39 is expressed as G ($N/mm^2$).

The winding pitch p1 of the conveying spiral 39 at the outer side of the curved portion 42 and the winding pitch p2 of the conveying spiral 39 at the inner side of the curved portion 42 are respectively expressed as follows:

$$p1=(R+D/2)/R\cdot p$$

$$p2=(R-D/2)/R\cdot p$$

Further, the shifting amount 51 of the conveying spiral 39 at the outer side of the curved portion 42 and the shifting amount 52 of the conveying spiral 39 at the inner side of the curved portion 42 satisfy the relationships:

$$\delta 1=|p1-p|=|(R+D/2)/R\cdot p-p|=(D/2)/R\cdot p$$

$$\delta 2=|p2-p|=|(R-D/2)/R\cdot p-p|=(D/2)/R\cdot p$$

Furthermore, a load F applied to the conveying spiral 39 is generally expressed as:

$$F=(\delta\cdot G\cdot d^4)/(8\cdot N\cdot D^3)$$

where δ represents a shifting amount of the conveying spiral 38, and N represents a number of windings of the conveying spiral 39.

Here, a torsion stress τ generated on the conveying spiral 39 is expressed as:

$$\tau=8\cdot p\cdot D/(\pi\cdot d^3)$$

Therefore, the torsion stress τ on a single winding coil portion (N=1) of the conveying spiral 39 and the outer diameter D of the conveying spiral 39 satisfy the following relationship:

$$\tau=\delta\cdot G\cdot d/(\pi\cdot D^2)$$

As described above, when δ1=δ2=(D/2)/R·p is substituted into the above equation, the torsion stress is expressed as follows:

$$\tau=((D/2)/R\cdot p\cdot G\cdot d)/(\pi\cdot D^2)$$

When Wahl stress correction factor is applied to the above described equation, the maximum torsion stress τmax is expressed as follows:

$$\tau max=((D/2)/R\cdot p\cdot G\cdot d)/(\pi\cdot D^2)\cdot((4c-1)/(4c-4)+0.615/c) \quad (1)$$

where c is defined as c=D/d.

From the material and the wire diameter d of the conveying spiral 39, the lower limit of a tensile strength σB of the conveying spiral 39 is determined based on JIS (Japan Industrial Standard). Based on the lower limit of the tensile strength σB, a fatigue limit τw of the conveying spiral 39 (for $10^7$ rotations) is expressed as follows:

$$\tau w=0.155\ \sigma B$$

By multiplying the maximum torsion stress τmax by a notch effect factor k (defined by grooves 39*a* generated in the manufacturing process of the conveying spiral 39), the value k·τmax is obtained. The fatigue failure can be prevented by determining the radius of curvature R of the curved portion 42 so that the above described value k·τmax is smaller than the fatigue limit τw as follows:

$$\tau w>k\cdot\tau max$$

Here, when the material of the conveying spiral 39 is SUS304-WPB, the wire diameter d of the wire 61 is 0.7 mm, the outer diameter D (average) of the conveying spiral 39 is 7.4 mm and the winding pitch p of the conveying spiral 39 is 9 mm, the lower limit of the tensile strength σB is determined to be 1850 MPa according to JIS B2709: 2000. Therefore, the fatigue limit τw of the conveying spiral 39 (for $10^7$ rotations) is determined as follows:

$$\tau w = 0.155\ \sigma B$$

$$= 286.8\ \text{MPa}$$

In this regard, 0.155 is a constant defined in the case where conveying spiral 39 repeats extraction and contraction.

Through experiments and simulations, the notch effect coefficient k of the conveying spiral 39 is set to 2.3 (k=2.3).

From this result, the maximum torsion stress τmax is set to be less than 124.7 MPa so as to satisfy the above described relationship: τw>k·τmax.

As a result of calculation, the above described maximum torsion stress τmax=124.7 MPa is obtained when the radius of curvature R is 67.2 mm. Therefore, the radius of curvature R of the conveying spiral 39 is set to 70 mm.

The notch effect factor k is a factor obtained by digitizing the shape of the groove 39*a*. The notch effect factor k is obtained by scanning the sectional shape of the wire 61 of the conveying spiral 39 and by performing calculation using a general-purpose nonlinear finite element analysis program "ABQ US/Standard v6.6-2" (produced by ABAQUA Inc.).

A durability test is performed on the conveying spirals 39 while changing the depth of the groove 39*a*.

In the durability test, the total number of rotations of the conveying spiral 39 is $10^7$ rotations. The radius of curvature R of the curved portion 42 is 70 mm. The material of the conveying spiral 39 is stainless steel "SUS304P". The wire diameter of the conveying spiral 39 is 0.6 mm. The outer diameter (average) of the conveying spiral 39 is 7.4 mm. The winding pitch p of the conveying spiral 39 is 9 mm. The evaluation of fatigue failure and the measurement of the depth of the groove 39*a* are performed using a laser microscope.

The relationship between the depth of the groove 39*a*, the notch effect factor k and the occurrence of fatigue failure is shown in TABLE 2.

TABLE 2

| | DEPTH OF GROOVE(μm) | | | | |
|---|---|---|---|---|---|
| | 0 | 3 | 5 | 8 | 15 |
| NOTCH EFFECT FACTOR k | 1 | 2.1 | 2.3 | 2.9 | 3.6 |
| FATIGUE FAILURE | ○ | ○ | ○ | X | X |

In TABLE 2, "O" indicates that fatigue failure does not occur, and "X" indicates that fatigue failure occurs. The fatigue failure does not occur in the case where the depth of the groove 39*a* is less than or equal to 5 μm and the notch effect factor k is in a range from 1 to 2.3, even when the conveying spiral 39 rotates for $10^7$ rotations. In contrast, the fatigue failure occurs in the case where the depth of the groove 39*a* is greater than 5 μm (i.e., the notch effect factor k is greater than 2.3) even when the conveying spiral 39 rotates less than $10^7$ rotations.

The durability test is also performed on the conveying spirals 39 having the radius of curvature R (of the curved portion 42) in a range from 30 mm to 70 mm. In this case, the same result as TABLE 2 is obtained. Further, the durability test is also performed on the conveying spirals 39 having the radius of curvature R less than 30 mm. In this case, fatigue failure occurs, because a torsion stress on the conveying spiral 39 increases. The durability test is not performed on the conveying spiral 39 having the radius of curvature R greater than 70 mm, because, in such a case, the size of the printer becomes large.

The durability test is also performed on the conveying spirals 39 having the wire diameter d (of the wire 61) in a range from 0.3 mm to 1.0 mm. In this case, the same result as TABLE 2 is obtained. Further, the durability test is also performed on the conveying spiral 39 having the wire diameter d less than 0.3 mm. In this case, the clogging of toner occurs, because the conveying spiral 39 can not push the waste toner even when the conveying spiral 39 is rotated (i.e., a conveying performance of the waste toner is degraded). The durability test is also performed on the conveying spirals 39 having the wire diameter greater than 1.0 mm. In this case, fatigue failure occurs, because a torsion stress of the conveying spiral 39 increases.

Further, the durability test is also performed on the conveying spirals 39 having the outer diameter D in a range from 7 mm to 8 mm. In this case, the same result as TABLE 2 is obtained. The durability test is also performed on the conveying spirals 39 having the winding pitch p in a range from 7 mm to 11 mm. In this case, the same result as TABLE 2 is obtained.

For example, when the depth of the groove 39*a* is 5 μm, the notch effect factor k is 2.3. In this case, the maximum torsion stress k·τmax in consideration of the shape of the groove 39*a* (i.e., the notch effect factor k) is smaller than the fatigue limit τw (i.e., k·τmax<τw), and therefore fatigue failure does not occur.

Third Embodiment

Next, the third embodiment of the present invention will be described. Components that are the same as those of the first embodiment are assigned the same reference numerals. Regarding advantages obtained by the components that are the same as those of the first embodiment, the explanations thereof in the first embodiment are herein incorporated.

Figure 12:
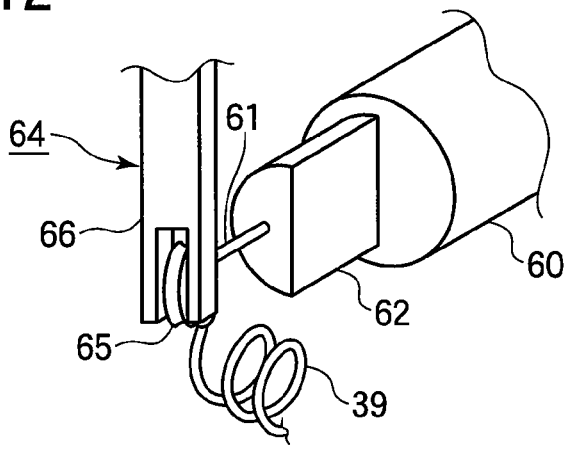
FIG. 12 is a perspective view for illustrating a manufacturing process of the conveying spiral according to the third embodiment of the present invention.
Figure 13:
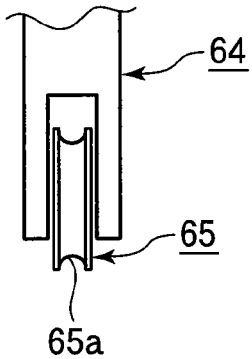
FIG. 13 is a perspective view for illustrating the manufacturing process of the conveying spiral according to the third embodiment of the present invention.

FIGS. 12 and 13 are perspective views for illustrating a manufacturing process of the conveying spiral according to the third embodiment of the present invention.

In the third embodiment, the wire 61 of the conveying spiral 39 is extruded from the cap 62 of the multi-forming machine 60 as was described in the first embodiment, and is formed into a coil-shape by a tool 64 as shown in FIG. 12.

In this embodiment, the tool 64 includes a roller 65 (i.e., a rotatable guide member) rotatably supported by a supporting member 66. The roller 65 has a groove 65*a* (i.e., a guide portion) formed on the circumference thereof. The groove 65*a* has, for example, U-shaped or V-shaped cross section as shown in FIG. 13. The wire 61 extruded from the cap portion 62 proceeds (almost straightly) toward the tool 64, and contacts the groove 65*a*. Further, the wire 61 is guided by the groove 65*a*, and changes the proceeding direction so that the wire 61 is formed into a coil-shape.

In this regard, the roller 65 is able to rotate along with the movement of the wire 61, and therefore rubbing of the wire 61 and the roller 65 can be prevented. Therefore, it becomes possible to restrict the formation of the grooves 39*a* (FIGS. 10 and 11) on the outer surface of the wire 61.

To be more specific, the depth of the groove formed on the outer surface of the wire 61 can be restricted to be less than or equal to 5 μm. Therefore, as was described in the first embodiment, it becomes possible to prevent fatigue failure on the conveying spiral 39, and to enhance the durability of the developer conveying apparatus 105.

In the above described embodiments, the developer conveying apparatus for conveying the waste developer has been described. However, the present invention is also applicable to a developer conveying apparatus for conveying a toner (a developer) to the image forming units 16Bk, 16Y, 16M and 16C as image forming portions.

Further, although a single component toner is used as a toner in the above described embodiments, it is possible to use various kind of toner such as two-component toner.

Furthermore, the printer has been described as an example of the image forming apparatus, the present invention is also applicable to a copier, a facsimile machine, a complex machine or the like.

While the preferred embodiments of the present invention have been illustrated in detail, it should be apparent that modifications and improvements may be made to the invention without departing from the spirit and scope of the invention as described in the following claims.

What is claimed is:

1. A developer conveying apparatus comprising:

a first developer storing portion;

a second developer storing portion, and a conveying pipe that connects said first and second developer storing portions, said conveying pipe including a tubular main body and a conveying spiral rotatably provided in said main body, wherein a groove is formed on a surface of said conveying spiral, and said groove has a depth less than or equal to 5 μm.

2. The developer conveying apparatus according to claim 1, wherein said conveying spiral has a wire diameter in a range from 0.3 mm to 1.0 mm.

3. The developer conveying apparatus according to claim 1, wherein said conveying spiral is made of stainless steel.

4. The developer conveying apparatus according to claim 1, wherein said conveying spiral has a curved portion, and said groove has a depth less than or equal to 5 μm at said curved portion.

5. The developer conveying apparatus according to claim 1, wherein said conveying spiral is produced by extruding a wire and by forming said wire into a coil-shape by causing said wire to contact a guide portion to change a proceeding direction of said wire, and wherein said guide portion is formed on a rotatable guide member so that said guide portion is movable along with said wire.

6. A developer conveying apparatus comprising:

a first developer storing portion;

a second developer storing portion, and a conveying pipe that connects said first and second developer storing portions, said conveying pipe including a tubular main body and a conveying member rotatably provided in said main body, wherein a notch effect factor of said conveying member obtained by nonlinear finite element analysis is in a range from 1.0 to 2.3.

7. The developer conveying apparatus according to claim 6, wherein said conveying member is produced by extruding a wire and by forming said wire into a coil-shape by causing said wire to contact a guide portion to change a proceeding direction of said wire, and wherein said guide portion is formed on a rotatable guide member so that said guide portion is movable along with said wire.

8. An image forming apparatus to which said developer conveying apparatus according to claim 1 is mounted.

* * * * *